US007055814B1

(12) United States Patent
Boss

(10) Patent No.: US 7,055,814 B1
(45) Date of Patent: Jun. 6, 2006

(54) APPARATUS FOR COLLECTING PRINTED PRODUCTS

(75) Inventor: Heinz Boss, Strengelbach (CH)

(73) Assignee: GRAPHA-Holding AG, Hergiswil (CH)

( * ) Notice: Subject to any disclaimer, the term of this patent is extended or adjusted under 35 U.S.C. 154(b) by 1169 days.

(21) Appl. No.: 09/426,023

(22) Filed: Oct. 25, 1999

(30) Foreign Application Priority Data

Oct. 26, 1998 (EP) ..... 98811074

(51) Int. Cl.
*B65H 41/00* (2006.01)

(52) U.S. Cl. ..... 270/52.29; 270/52.14; 270/52.18; 270/52.26; 270/52.3

(58) Field of Classification Search ..... 270/52.26, 270/52.29, 52.3, 52.18, 52.14
See application file for complete search history.

(56) References Cited

U.S. PATENT DOCUMENTS 3,917,252 A * 11/1975 Harder et al. ..... 270/52.05
3,966,185 A * 6/1976 McCain et al.
4,121,818 A * 10/1978 Riley et al. ..... 270/52.29
4,149,711 A * 4/1979 Jackson ..... 270/1.02
4,384,709 A 5/1983 McCain et al.
4,395,031 A * 7/1983 Gruber et al. ..... 270/52.29
4,493,482 A * 1/1985 Valenti et al. ..... 270/12
4,768,766 A * 9/1988 Berger et al. ..... 270/1.02
4,789,147 A 12/1988 Berger et al.
5,083,281 A * 1/1992 Rabindran et al. ..... 700/220
5,114,128 A * 5/1992 Harris, Jr et al. ..... 270/1.03
5,678,812 A * 10/1997 Hartsoe ..... 270/52.16
5,685,533 A * 11/1997 Hartsoe ..... 271/11
5,777,443 A 7/1998 Chang
5,810,346 A * 9/1998 Jorg ..... 270/59
5,819,663 A * 10/1998 Klaas et al. ..... 101/483
5,957,263 A * 9/1999 Espenschied ..... 198/349.95
5,967,503 A * 10/1999 Newsome ..... 270/52.04
5,974,150 A * 10/1999 Kaish et al. ..... 380/25
6,019,047 A * 2/2000 Klaas et al. ..... 101/483
6,082,724 A * 7/2000 Kahlig et al. ..... 270/52.14
6,095,511 A * 8/2000 Jager ..... 270/52.29
6,095,740 A * 8/2000 Hollenstein et al. ..... 412/4
6,105,955 A * 8/2000 Rawlings et al. ..... 271/11

FOREIGN PATENT DOCUMENTS

EP 0727379 8/1996

* cited by examiner

*Primary Examiner*—Gene O. Crawford
*Assistant Examiner*—Jeffrey A. Shapiro
(74) *Attorney, Agent, or Firm*—Friedrich Kueffner

(57) ABSTRACT

An apparatus for collecting, stitching and/or cutting printed products includes an endless collector chain and feeders arranged one behind the other and above the collector chain for placing the printed products on the collector chain, and a stitching device for stitching or stapling the printed products, as well as a delivery unit for removing the printed products at the conveying end of the collector chain and for supplying the printed products to further processing. The apparatus also includes a drive unit which includes at least one servo drive which is controlled by a drive connected to the collector chain through a signal line in a timed synchronous manner and which drives additional units of the apparatus.

10 Claims, 2 Drawing Sheets

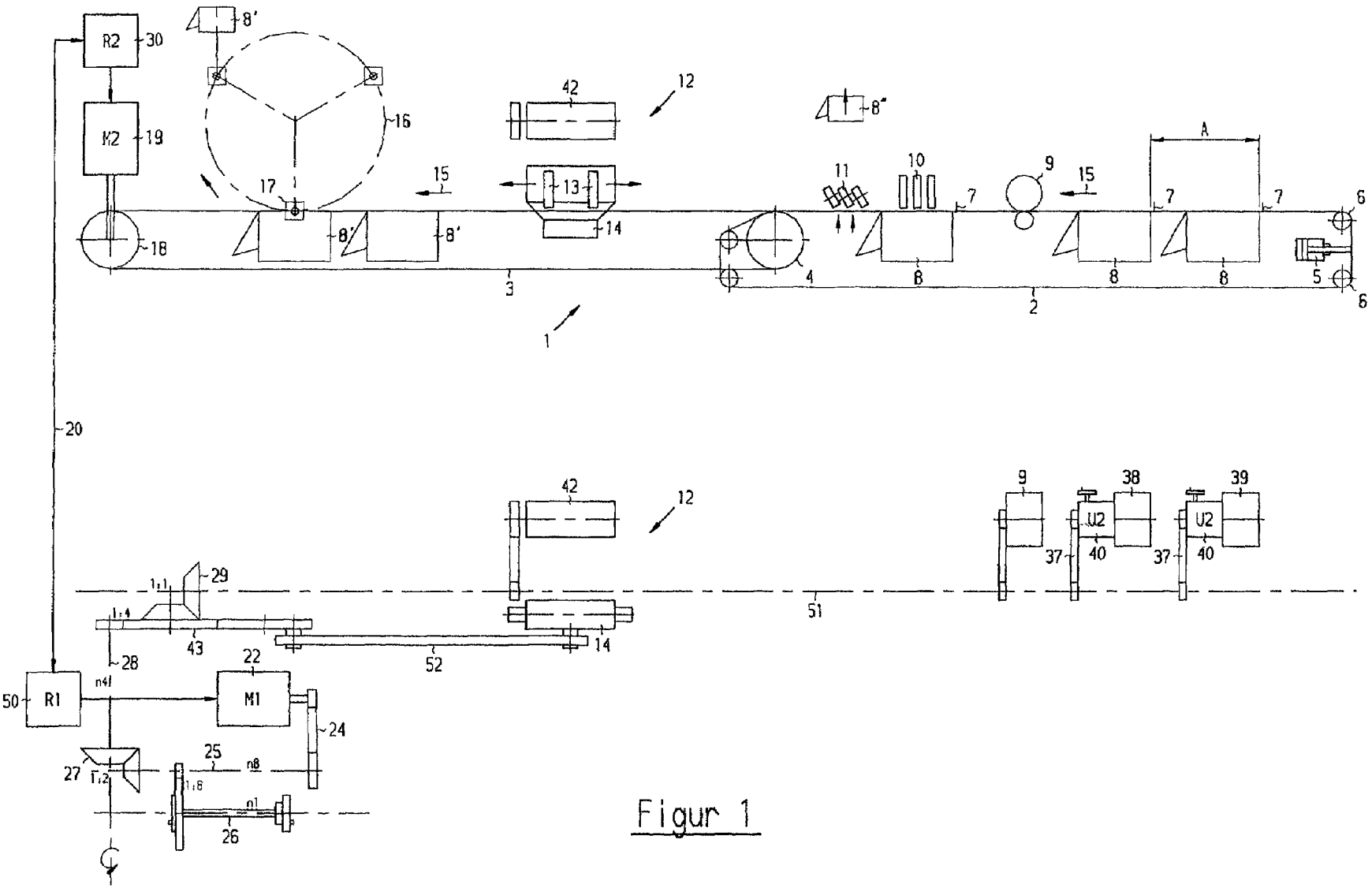
Figur 1

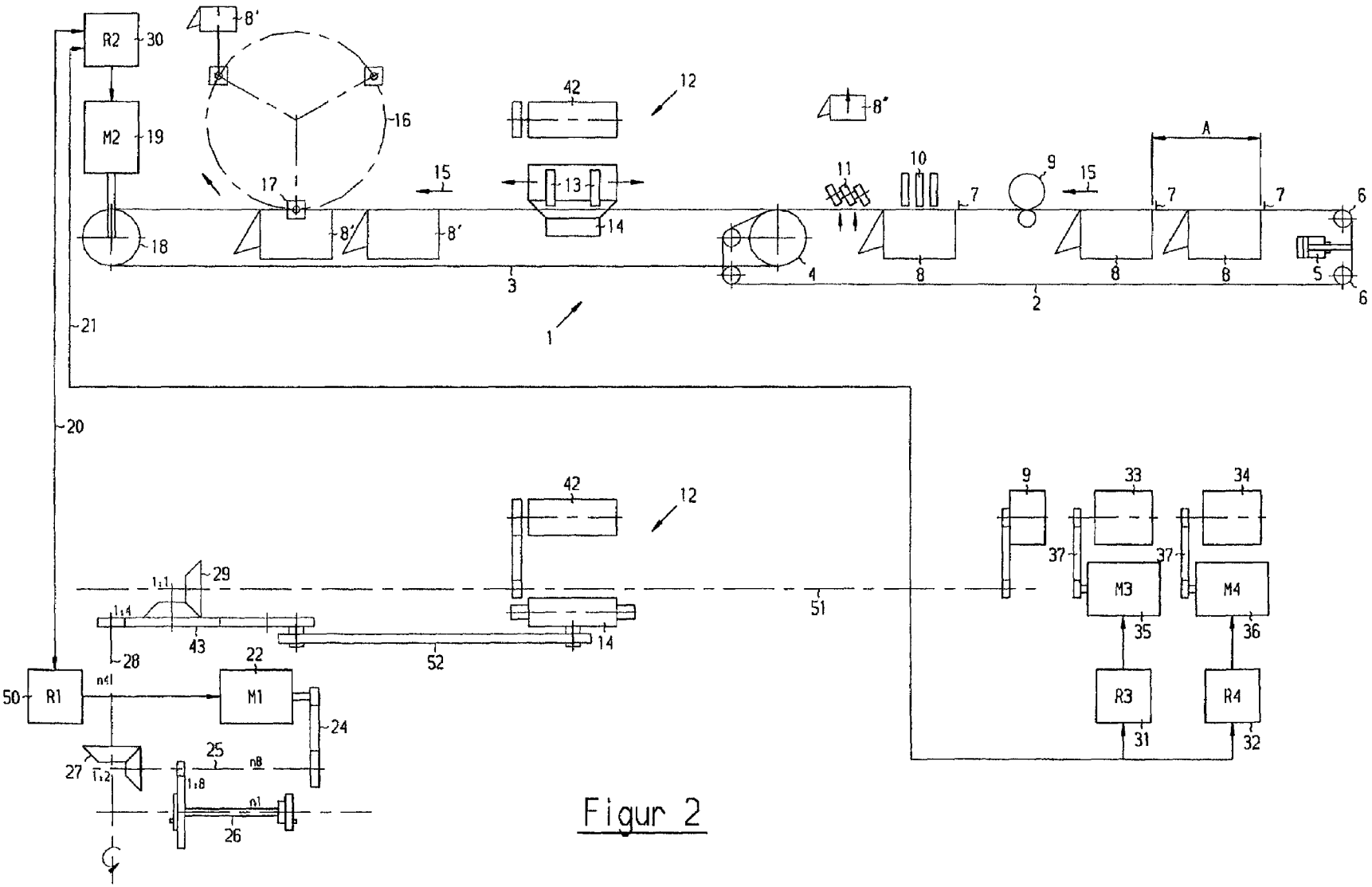
Figur 2

APPARATUS FOR COLLECTING PRINTED PRODUCTS

BACKGROUND OF THE INVENTION

1. Field of the Invention

The present invention relates to an apparatus for collecting, stitching and/or cutting printed products. The apparatus includes an endless collector chain and feeders arranged one behind the other and above the collector chain for placing the printed products on the collector chain, and a stitching device for stitching or stapling the printed products, as well as a delivery unit for removing the printed products at the conveying end of the collector chain and for supplying the printed products to further processing. The apparatus also includes a drive unit.

2. Description of the Related Art

Apparatus of the above-described kind have been known for a long time and have the purpose of collecting printed products and subsequently supplying them to another processing station. A stitching machine for stitching the collected printed products is usually arranged following the feeders. Such stitching machines and also suitable feeders are known in the art. The collector chain is constructed in the area of the feeders as a simple chain and has in regular intervals carrier members which protrude upwardly or laterally and on which the printed products placed on the collector chain are transported. The collector chain is constructed as a double chain in the area of the stitching machine and facilitates stitching of the collected printed products which rest astride on the collector chain. Prior to stitching, the printed products are frequently provided with addresses, for example, with a so-called ink jet device. Suitable for lifting the collected, stitched and addressed printed products is, for example, a conventional delivery unit which, for example, conveys the printed products to a trimmer which cuts the printed products.

A shiftable change gear unit is provided for driving the collector chain in the conventional apparatus (Harris saddle stitcher). This change gear unit makes it possible to adapt the chain speed to a collected chain with 21 or 14 inch divisions.

Alternatively, a drive of the collector chain is known in the art in a Müller Martini saddle stitcher (Prima) with a superimposed gear unit which facilitates timing or synchronizing of the collector chain during travel. The stitching mechanism and the stitching carriage of a stitching machine are additionally driven through a crank drive and an angular gear unit.

For achieving a clean and distortion-free addressing of the printed products with the above-mentioned ink jet device, an oscillation-free travel of the collector chain is important. At certain speeds, the feeders or the translatory movements of the stitching carriage and the trimmer produce oscillations which are transmitted to the collector chain and finally to the printed products. Such oscillations lead to distortions of the printed addresses. For preventing such oscillations, U.S. Pat. No. 4,384,709 proposes to additionally tension and drive the collector chain in the tensioning station and to provide the shaft which is connected to the main drive with a centrifugal mass. This type of oscillation damping produces relatively poor results considering the expenditures and must be adapted to the respective machine configuration.

SUMMARY OF THE INVENTION

Therefore, it is the primary object of the present invention to provide a way for avoiding vibrations at the collector chain, and to provide optimum prerequisites for addressing the printed products.

In accordance with the present invention, the drive unit includes at least one servo drive which is controlled by a drive connected to the collector chain through a signal line in a timed synchronous manner and which drives additional units of the apparatus.

The configuration according to the present invention provides the following significant advantages:

- vibrations of the stitching machine and of the trimmer cannot be transmitted to the collector chain;
- the basic adjustment of the collector chain position relative to the delivery unit can be computed automatically and can be adjusted precisely;
- the position of the collector chain relative to the delivery unit can be corrected during operation.

If, in accordance with a further development of the invention, each feeder is also driven by a servo drive, the following additional advantages are provided:

- the collector chain and the feeders can be operated independently of the remaining parts of the apparatus;
- the superimposed gear units which were necessary in the past can be omitted;
- the timing of the feeders relative to the collector chain can be computed in accordance with the size of the printed products;
- an adjustment of the timing is possible during operation; and
- a timing position which is displaced as the result of a problem can be automatically eliminated.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 1 is a kinematic drive diagram of a first embodiment of the apparatus according to the present invention; and FIG. 2 is a kinematic drive diagram of a second embodiment of the apparatus according to the present invention.

DESCRIPTION OF THE PREFERRED EMBODIMENTS

The apparatus illustrated in FIG. 1 includes a conventional collector chain 1. The collector chain 1 is composed of a single collector chain 2 and a double collector chain 3 which are connected to each other through a transfer element 4. The conveying direction is indicated by arrows 15 and takes place from the right to left as seen in FIG. 1. The single collector chain 2 is guided at a distance from the transfer element 4 about two guide wheels 6 and is tensioned between the guide wheels 6 by a tensioning station 5. In accordance with a chain division of, for example, 14 or 21 inches, carrier members 7 are arranged in regular intervals A on the collector chain 2, wherein, however, not all carrier members 7 are shown in the drawing. These carrier members 7 are mounted so as to protrude towards the top or side and to convey the printed products 8 in the direction of the arrows 15 towards the double collector chain 3. This double collector chain 3 is also provided with carrier members, not shown.

The double collector chain 3 is provided at its front end with a drive wheel 18 which is driven by a drive 19, i.e., a servo drive. This drive 19 is composed of an electric motor M2 and a control unit 30. The movement of the double collector chain 3 is transmitted by means of the transfer element 4 to the single collector chain 2.

The folded printed products 8 are pulled by means of two successively arranged feeders 38 and 39 from a stack, not shown, and are placed on the single collector chain 2. The feeders 38 and 39 have conventional opening drums, not shown, which open the printed products 8 in such a way that they are placed astride onto the single conveyor chain 2, as seen in the drawing. Of course, the feeders 38 and 39 operate synchronously relative to the collector chain 2. It is also possible to arrange more than two feeders one behind the other.

The two feeders 38 and 39 each have a superimposed gear unit 40 which is connected with a drive member 37 to a principal shaft 51 of a principal drive 22. The timing of the feeders 38 and 39 relative to the collector chain 2 can be adjusted by means of the superimposed gear units 40. Superimposed gear units 40 of this type are known in the art.

Following the feeders 38 and 39 in the conveying direction, a thickness measuring device 9 is provided for measuring the thickness of the collected printed products 8. The thickness measuring device 9 is also driven by the principal drive shaft 51. Arranged following the thickness measuring device 9 in the conveying direction 15 is an addressing unit 10, particularly an ink jet addressing unit, which places addresses on the printed products 8. This placement of addresses is possible during operation, i.e. without stopping the printed products 8.

Incomplete products 81" can be lifted from the single collector chain 2 by means of air nozzles 11.

As mentioned above, the double collector chain 3 makes it possible to carry out stitching of the collected printed products 8. For this purpose, a conventional stitching machine 12 is provided which includes a stitching carriage 14 and, for example, two stitching heads 13. The stitching heads are actuated by a stitching mechanism 42 which is actuated by the principal shaft 51. The stitching carriage 14 carries out a stroke in such a way that the printed products 8 can be stitched during travel. For carrying out this stroke, the stitching carriage is connected to a crank rod 52 which is hinged to a drive wheel 42 of a principal drive 22. The rotary movement of the drive wheel 43 is transmitted through an angular gear unit 29 to the principal drive shaft 51. The principal drive 22 is provided with a servo motor M1 which includes a control unit 50, and a drive member 24. It is additionally possible to drive, through a shaft 25 and an angular gear unit 27, particularly a trimmer 26 for cutting the printed products as well as an inserting machine, not shown. The control unit 50 of the servo drive 22 is connected through an electrical signal line 20 with control unit 30 of the drive 19. The control unit 30 and the control unit 50 are configured in such a way that the drive 19 forms the so-called master and the servo motor M1 forms the so-called slave. The drive 19 provides the servo drive 22 with control commands. The servo drive 22 follows the drive 19 synchronously with respect to rotation.

Consequently, the collector chain 1 can travel more uniformly and evenly because the servo drive 22 suppresses the vibrations produced by the stitching apparatus and the trimmer and other units, on the one hand, and the drive 19 of the collector chain 1 is mechanically uncoupled, on the other hand, while a certain non-uniform travel is acceptable for other units. As a result, vibrations of the feeders 38, 39 of the stitching unit and of the trimmer 29 cannot be transmitted to the collector chain 1. If the drive 19 is a servo drive, it additionally facilitates an infinitely variable and precise adjustment of the position of the collector chain 1 during operation. The control unit 30 of the servo drive 19 makes possible an electronic change of the carrier member division from 21 to 14 inches or vice versa. This makes possible an automatic adjustment of the position of the collector chain 1, for example, as a function of the size of the printed products 8. It is also important in this connection that after a stoppage the servo drive 19 makes it possible to start up the collector chain 1 with the printed products in the exact position. An overload function is preferably integrated in the servo drive 19. It is also important that the servo drive 19 makes it possible to independently adjust the division of the carrier members on the collector chain 1 relative to the remaining units of the apparatus.

The stitched printed products 8' are grasped by means of gripping members 17 of the conventional delivery units 16 and are supplied to the trimmer 26 where the printed products 8' are usually cut at three sides. The position of the collector chain 1 relative to this delivery unit 16 is essential and the servo drive 19 makes it possible to correct this position during operation.

The embodiment of FIG. 2 differs from that of FIG. 1 in that feeders 33 and 34 are provided which are not driven by the principal drive shaft 51, but are each driven by a separate servo drive 35 and 36, respectively. These servo drives 35 and 36 each have an electric motor M3 and M4, respectively, and a control unit 31 and 32, respectively. The rotary movement is transmitted to the feeders 33 and 34 through drive members 37. The feeders 33 and 34 otherwise correspond to the feeders 38 and 39 of FIG. 1. The servo drives 35 and 36 are connected through signal lines 21 to the servo drive 19 and the control unit 30. The servo drive 19 forms the master and the servo drives 35 and 36 form the slaves. Consequently, the servo drives 35 and 36 follow the servo drive 19. An overload function is also preferably integrated in the servo drives 35 and 36. The servo drives 35, 36 can be secured against overload by an adjustable current limitation. It is also important that the superimposed gear units 40 provided in the embodiment of FIG. 1 are not required in the embodiment of FIG. 2. In the embodiment of FIG. 2, the operation of the superimposed gear units can be carried out electronically through the control units 31 and 32.

Of course, it is possible to use the apparatus according to the present invention for processing in accordance with the 2:1 operation. A 2:1 operation is carried out when two feeders are in operation with the same sheets alternatingly with half speed.

The timing position of the feeders 33 and 34 relative to the collector chain 1 can be stored in the control units 31 and 32. After a stoppage which causes the position to be lost, the control units 31 and 32 can automatically find the stored position. When selective binding is carried out, the feeders 33 and 34 can be easily switched on and off in a controlled manner during operation of the apparatus; this means that the feeders are treated gently.

Since the feeders 33 and 34 are not mechanically connected to the principal drive shaft 51, the feeders can be mounted, for example, so as to be foldable upwardly, which makes it possible, for example, to make room for a card applicator.

It is also much more simple than in the past to adjust the height of the feeders 33 and 34 relative to the collector chain 1.

The trimmer 26 mentioned above can be driven by a separate servo motor, not shown. This makes it possible to separately operate the trimmer 26.

The servo drive technology according to the present invention will make it possible, for example, to drop the electrostatically charged sheets at a higher speed onto the collector chain when the saddle stitcher is stopped or to hold back the sheets in the feeder, or, when the saddle stitcher is once again started up, to switch on the feeder only when a certain speed is reached. This makes it possible to more safely feed the electrostatically charged printed products to the collector chain.

The invention is not limited by the embodiments described above which are presented as examples only but can be modified in various ways within the scope of protection defined by the appended patent claims.

I claimed:

1. An apparatus for collecting, stitching and/or cutting printed products, the apparatus comprising an endless collector chain and successively arranged feeders mounted above the collector chain for placing the printed products on the collector chain, a stitching device for stitching the printed products, and a delivery unit for removing the printed products at a conveying end of the collector chain and for supplying the printed products for further processing, the apparatus further comprising a drive unit comprised of at least one first servo drive and a collector chain drive, connected to the collector chain and configured to control the first servo drive through a signal line in a synchronously timed manner, wherein the first servo drive is configured to drive additional units of the apparatus.

2. The apparatus according to claim 1, wherein the servo drive is configured to drive at least one of a stitching machine and a trimmer and at least one feeder.

3. The apparatus according to claim 1, comprising additional servo drives for individually driving the feeders.

4. The apparatus according to claim 1, wherein the collector chain drive is a second servo drive.

5. The apparatus according to claim 3, wherein the collector chain drive is configured as master and the servo drive and the additional servo drives are each configured as slave.

6. The apparatus according to claim 3, wherein the additional servo drives are configured to follow the collector chain drive configured as a servo drive synchronously with respect to rotation.

7. The apparatus according to claim 1, wherein each feeder is configured to be operated individually relative to the collector chain.

8. The apparatus according to claim 7, comprising electronic means for adjusting a speed of the collector chain for different chain divisions.

9. The apparatus according to claim 4, wherein the servo drive of the collector chain comprises an overload function.

10. The apparatus according to claim 1, comprising electronic means for carrying out the time adjustment of the feeders relative to the collector chain.

* * * * *